United States Patent [19]

Deschapelles

[11] 3,948,310

[45] Apr. 6, 1976

[54] BOTTOM BLOCK FOR D.C. CASTING OF ALUMINUM ROLLING INGOTS

[75] Inventor: Jorge B. Deschapelles, Ravenswood, W. Va.

[73] Assignee: Kaiser Aluminum & Chemical Corporation, Oakland, Calif.

[22] Filed: Aug. 12, 1974

[21] Appl. No.: 496,798

[52] U.S. Cl. ..... 164/274; 249/174

[51] Int. Cl.[2] ..... B22D 11/08

[58] Field of Search ..... 249/174, 204; 164/274, 164/89, 282, 283 S

[56] References Cited

UNITED STATES PATENTS 1,335,685 3/1920 Howard et al. ..... 249/174 UX 2,093,024 9/1937 Williams ..... 249/174 UX

FOREIGN PATENTS OR APPLICATIONS 901,091 7/1945 France ..... 164/274

*Primary Examiner*—R. Spencer Annear

*Attorney, Agent, or Firm*—Paul E. Calrow; Edward J. Lynch

[57] ABSTRACT

This invention relates to an improved bottom block design for the D.C. casting of large aluminum rolling ingots wherein vertical extending, pyramid shaped projections are provided at the corners of the generally rectangularly shaped bottom block. Significant reductions in dish-shaped butt cracks and corner cold folds are found with the present design.

8 Claims, 10 Drawing Figures

BOTTOM BLOCK FOR D.C. CASTING OF ALUMINUM ROLLING INGOTS

BACKGROUND OF THE INVENTION

This invention is directed to the vertical D.C. casting of aluminum, and, in particular, to an improved bottom block design for the vertical D.C. casting of large aluminum rolling ingots. As used herein, aluminum refers to both aluminum and aluminum alloys.

During the initial casting of large aluminum rolling ingots, the bottom surface of the forming ingot in contact with the bottom block begins to curl away from the surface of the bottom block as the metal begins to solidify and contract. This results in the normal curved shape of the butt end of the ingot as shown in FIG. 1. Frequently, as the butt end of the ingot begins to curl away from the top of the bottom block, the forming ingot shell will not be sufficiently strong to support itself and one side of the ingot will start to collapse about a point approximately one-eighth to one-half (usually about one-fourth) of the width of the ingot. This results in a dish-shaped butt surface as shown in FIG. 2. Because of the stress riser left in the solidified ingot having a dish-shaped butt, usually a crack will form at the stress point at the edge of the butt as shown in FIG. 2 which can ultimately extend the entire length of the ingot and thereby require its scrapping.

The formation of dish-shaped butts is a significant problem in casting with steel bottom blocks especially in casting alloys having an intermediate size melting range (e.g., 35°–200°F., particularly 40°–140°F.). With relatively pure alloys, such as 1100 (Aluminum Association alloy designation), the melting range is so narrow that rapid solidification of the butt is assured under normal casting conditions, thereby minimizing the chances of forming a dish-shaped butt. On the other hand, with highly alloyed materials, even though the temperature range between the solidus and liquidus points is broad, the strength of the forming ingot due to the alloying constituents is sufficiently high to preclude the formation of dish-shaped butts.

The dish-shaped butt is a characteristic primarily of steel bottom blocks. In contrast, aluminum bottom blocks provide such a rapid solidification of the butt end of the ingot that the dish-shape is usually prevented from forming. However, because of the rapid solidification promoted by the aluminum bottom block, cold folds and spillouts are created at the corners and end of the ingot butt. These are apparently due to the too rapid extraction of heat from the corners and end of the butt as the ingot curls up from the bottom block and away from the mold too rapidly, thereby allowing the cold folds and spillout to develop.

A typical prior art double curvature steel bottom block is shown in FIG. 3 and a typical aluminum bottom block is shown in FIG. 4 and FIG. 5.

Against this background, the present invention was developed.

DESCRIPTION OF THE INVENTION

Figure 1:
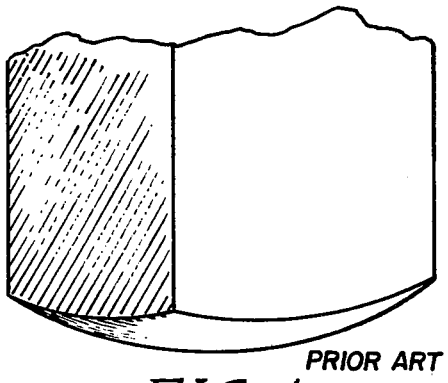
FIG. 1 and FIG. 2 illustrate conventional large aluminum rolling ingot.

The present invention is directed to an improved bottom block design particularly suitable for the vertical D.C. casting of large aluminum rolling ingots, i.e., having a cross section of at least 10 × 20 inches. The bottom block of the present invention, which can be fabricated from aluminum or steel, effectively minimizes the formation of a dish-shaped butt and the resultant cracks, as well as corner cold folds and the like. Moreover, because dish butt cracks are controlled with the present bottom block design, a high initial casting speed can be utilized to avoid the formation of a thick butt. Furthermore, the keying action of the peripheral ledge inhibits ingot bowing.

Reference is made to FIGS. 6–9 which illustrate an embodiment of the present invention. The bottom block 10 comprises a horizontally disposed plate member 11 of generally rectangular cross section having at each corner a pyramid-shaped projection 12. Preferably, a ledge 13 is provided around the periphery of the bottom block top between the pyramid-shaped projections.

The projections 12 generally are triangular pyramids. The vertical faces 14 and 15 of the pyramids are flush with the sides 16 of the bottom block to thereby make a continuous vertical plane therewith in order to prevent any significant quantities of molten aluminum from solidifying between the projections and mold bore during the initiation of casting. The vertical faces 14 and 15 of the projections should not extend laterally along the length and width more than one-third of the distance thereof (distance a and b of FIG. 9). The inclined face 17 of the pyramid 12 can be flat (as shown) or curved. Generally, the height of the projection should be from about 1–5 inches as measured from the lowest point of the bottom block periphery.

The ledge 13 around the periphery of the bottom block is at least 0.5 inch wide (distance c of FIG. 9), preferably at least 1 inch wide. The width of the ledge at the quarter points (distance d of FIG. 9) along the long sides of the bottom block is preferably from about 10–30% of the bottom block width. Although the top surface 18 of the bottom block enclosed by the peripheral ledge and the projections is shown as a concave curved surface in the drawings, it can be of any convenient shape.

The corner projections provided in the bottom block design of the present invention effectively minimize the cold folds characteristic of prior art bottom blocks. Apparently, the projections provide for a reduced solidification rate at the corners of the ingot butt by preventing excessive amounts of coolants from impinging on the ingot corners during the initial solidification thereof. Further, the projections allow for the gradual introduction of the freshly solidified ingot corners into the coolant stream. On the other hand, the ledge provided in the present invention accelerates the heat transfer at the bottom of the butt, particularly at the quarter points, so as to rapidly solidify the forming ingot and to prevent any collapsing of the solidifying ingot butt about a stress point (usually a quarter point) as the ingot is withdrawn from the mold. Moreover, the peripheral ledge of the present bottom block design provides a keying action which effectively prevents any movement of the butt end of the ingot with respect to the bottom block which can ultimately lead to the bowing of the ingot during casting.

Although the bottom block of the present invention is useful in minimizing cold fold formation in the vertical D.C. casting of all aluminum alloys, it is of particular benefit in preventing dish butt cracks in those alloys having an intermediate size temperature differential between the solidus and the liquidus points, i.e., from about 35°–200°F and particularly 40°–140°F. With a temperature differential substantially less than 35°F, the solidification is usually so rapid during normal casting procedures that dish-shaped butts cannot be formed. Most aluminum alloys which have a temperature differential above 200°F, between solidus and liquids are strong enough due to the alloying constituents to prevent the solidifying ingot from collapsing about a stress point. The bottom block design is particularly suitable for casting Al-Mg alloys, such as the 5000 series alloys, Al-Mg-Si alloys such as the 6000 series alloys and to Al-Mn alloys such as the 3000 series alloys. Typical aluminum alloys having intermediate melting ranges are set forth in the table below.

| Aluminum Association Alloy Designation | Nominal Composition[1] % by Weight | Melting Range Of |
|---|---|---|
| 3004 | 1.2% Mn, 1.0% Mg | 40 |
| 5252 | 2.5%Mg | 75 |
| 5056 | 5.1% Mg, 0.12% Mn, 0.12% Cr | 120 |
| 5083 | 4.45% Mg, 0.6% Mn, 0.15% Cr | 110 |
| 6061 | 1.0% Mg, 0.6% Si, 0.27% Cu, 0.20% Cr | 125 |
| 6063 | 0.7% Mg, 0.40% Si | 65 |

[1]Balance aluminum and inconsequential amounts of other elements.

Figure 3:
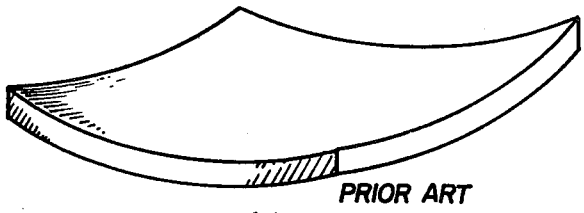
FIG. 3 represents a prospective view of a conventional double curvature steel bottom block.
Figure 2:
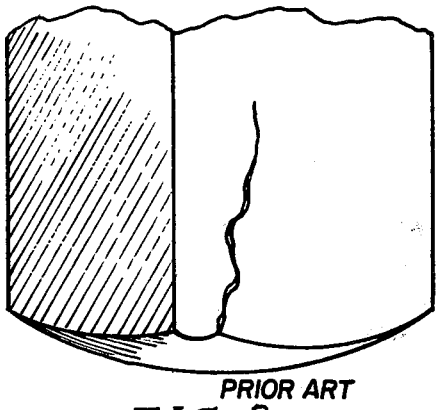
Figure 4:
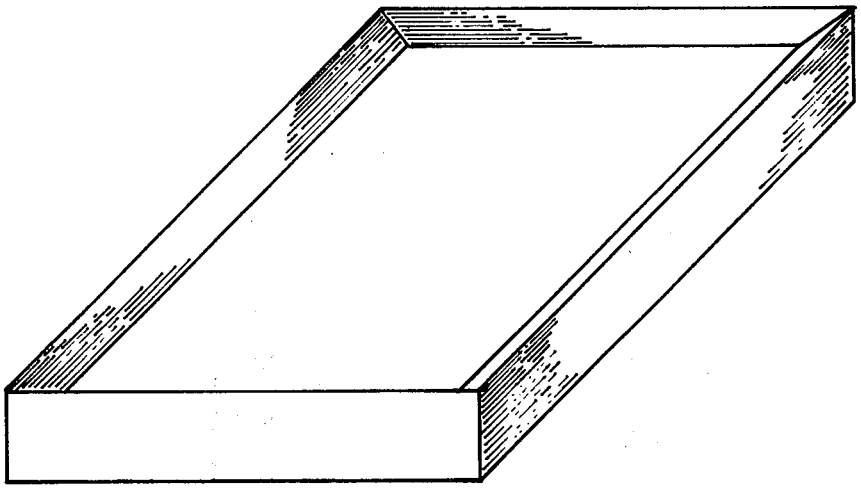
PRIOR ART FIG. 4
FIG. 4 represents a prospective view of a conventional aluminum bottom block.
Figure 5:
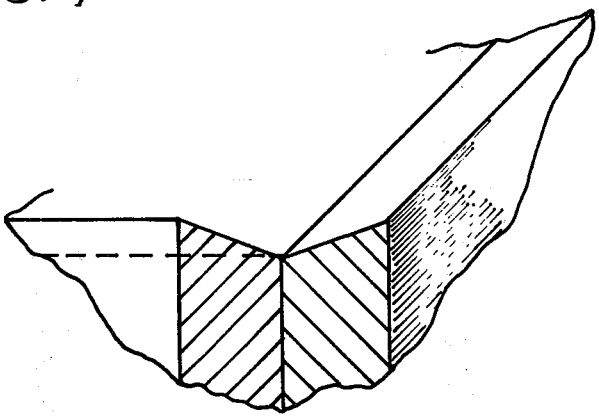
PRIOR ART FIG. 5
FIG. 5 is a prospective view partially in section of the bottom block design shown in FIG. 4.
Figure 6:
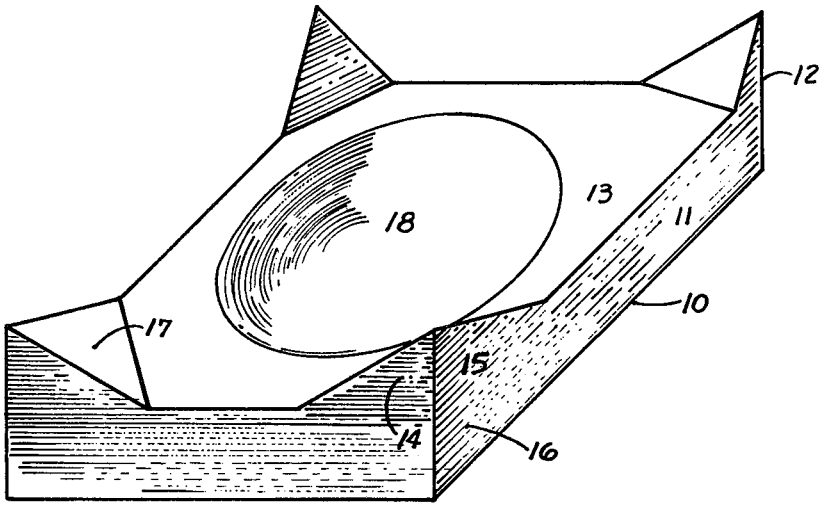
FIG 6 is a perspective view of a bottom block design of the present invention.
Figure 7:
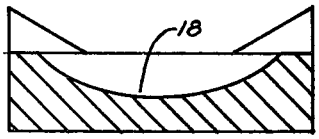
FIGS. 7 and 8 are cross-sectional views of the embodiment shown in FIG. 6
Figure 9:
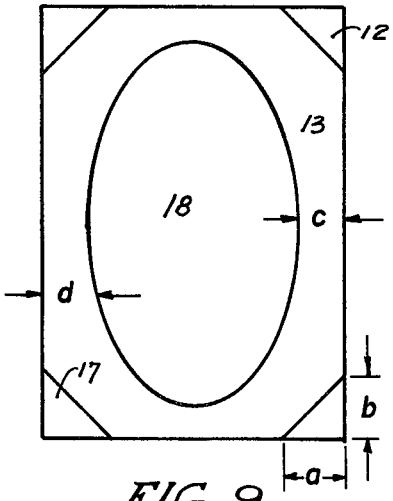
FIG. 9 is a plan view of the embodiment shown in FIG. 6.
Figure 8:
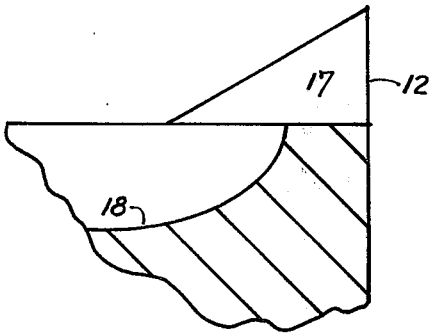
Figure 10:
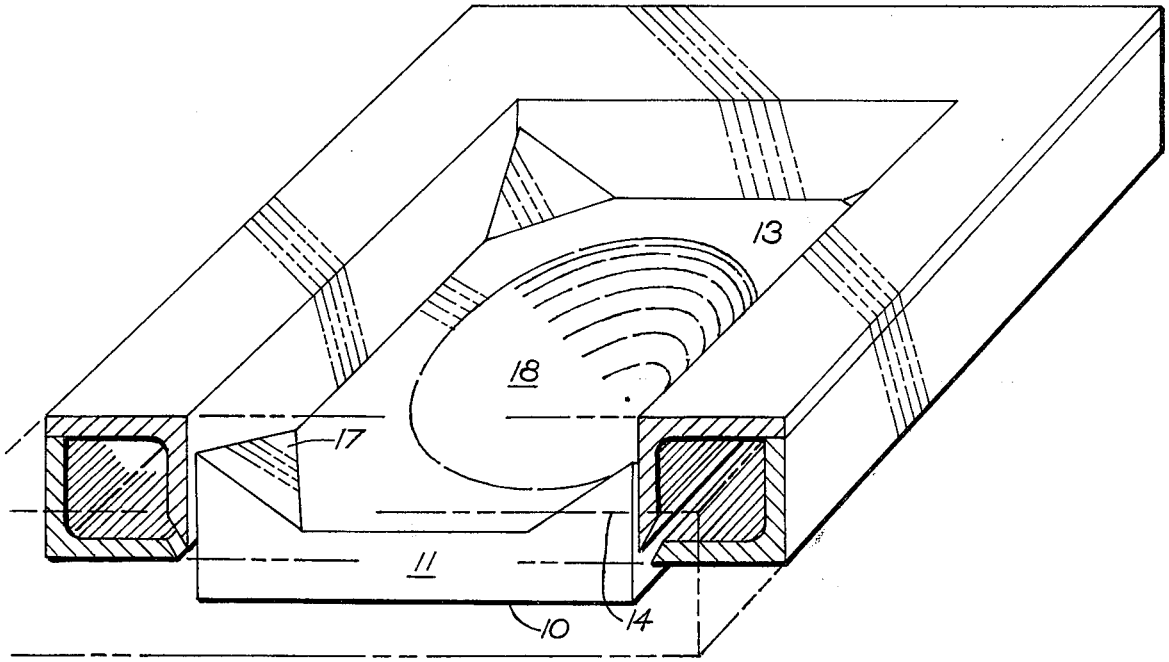
FIG. 10 illustrates the invention wherein the improved bottom block is positioned within the bore of a DC casting mold.

The following example is given to further illustrate the present invention with no intention to limit the scope thereof. The bottom block shape in accordance with the present invention was utilizied for the vertical D.C. casting of approximately 400 rolling ingots (3004 alloy). The horizontal dimensions of the bottom block were 20 inches × 51.5 inches. The corner projections extended laterally 10 inches along the length of the bottom block and 3 inches along the width of the bottom block and were approximately 2.5 inches high. The peripheral ledge between the corner projections ranged from 1 inch at the midpoint of the long side of the bottom block to about 2.5 inches at the quarter points. The crack rate caused by dish-shaped butts from this group of ingots was approximately 0.24%, which is to be compared with a dish-shaped butt crack formation of about 2 to 5% when utilizing a conventional bottom block as shown in FIG. 3. Corner cold folds were essentially eliminated in the casting of these 400 ingots. Moreover, the initial casting speed was increased 40%

(1.25 to 1.75 inches/min.) which thereby reduced the fat butt by 0.5 inch.

It is obvious that various modifications and improvements can be made to the present invention without departing from the spirit thereof and the scope of the appended claims.

What is claimed is:

1. In a vertical DC casting apparatus for the casting of large rectangular-shaped aluminum rolling ingots conprising a DC casting mold and a bottom block, wherein the bottom block is adapted to be inserted into the mold before casting to thereby seal the discharge end of the mold and wherein the bottom block is adapted to be withdrawn from the mold during casting and thereby allow the solidifying ingot to emerge from the discharge end of the mold where coolant is applied onto the surfaces of the ingot, the improvement comprising a bottom block of generally rectangular horizontal cross section having generally pyramid-shaped projections at each corner on the top of the bottom block which extend laterally along the edges of the bottom block a distance from the corner of not more than one-third of the bottom block length and width respectively, for reducing the solidification rate at the corners of the solidifying ingot during the initial part of casting by preventing the application of coolant onto the corners of the ingot when the ingot initially emerges from the discharge end of the mold.

2. The bottom block of claim 1 wherein said projections are generally of a triangular pyramid shape.

3. The bottom block of claim 1 wherein a ledge at least 0.5 inch wide is provided about the periphery of the bottom block on the top surface thereof between the said projections.

4. The bottom block of claim 1 wherein said pyramidal projections are from about 1–5 inches in height as measured from the lowest point along the upper periphery of said bottom block.

5. The bottom block of claim 3 wherein said ledge is at least 1 inch wide.

6. The bottom block of claim 3 wherein the width of said ledge at the quarter points of said bottom block are from about 10–30% of the width of said bottom block.

7. The bottom block of claim 1 wherein said bottom block is fabricated from a metal selected from the group consisting of steel and aluminum.

8. The improvement of claim 1 wherein the top surface of said bottom plate is provided with a dish-shaped recess in the center portion thereof.

* * * * *